US011246369B2

(12) United States Patent
Krynock et al.

(10) Patent No.: US 11,246,369 B2
(45) Date of Patent: Feb. 15, 2022

(54) HELMET PADS WITH SLIP LAYERS

(71) Applicant: Specialized Bicycle Components, Inc., Morgan Hill, CA (US)

(72) Inventors: Mike Krynock, Morgan Hill, CA (US); Clint Mattacola, Morgan Hill, CA (US); Jason Walton, Campbell, CA (US)

(73) Assignee: SPECIALIZED BICYCLE COMPONENTS, INC., Morgan Hill, CA (US)

( * ) Notice: Subject to any disclaimer, the term of this patent is extended or adjusted under 35 U.S.C. 154(b) by 272 days.

(21) Appl. No.: 15/940,255

(22) Filed: Mar. 29, 2018

(65) Prior Publication Data

US 2019/0297984 A1 Oct. 3, 2019

(51) Int. Cl.
*A42B 3/12* (2006.01)
*A42B 3/06* (2006.01)

(52) U.S. Cl.
CPC . *A42B 3/12* (2013.01); *A42B 3/06* (2013.01)

(58) Field of Classification Search
CPC .. A43B 3/00; A43B 3/06; A43B 3/063; A43B 3/064; A43B 3/066; A43B 3/10; A43B 3/121; A43B 3/12; A43B 3/125; A43B 3/127; A43B 3/128
USPC ..... 2/412, 410, 411, 414, 413
See application file for complete search history.

(56) References Cited

U.S. PATENT DOCUMENTS

| | | | | |
|---|---|---|---|---|
| 8,316,512 | B2 * | 11/2012 | Halldin | A42B 3/064 24/90.1 |
| 8,615,817 | B2 | 12/2013 | Phillips | |
| 9,603,406 | B2 | 3/2017 | Halldin | |
| 9,872,532 | B2 | 1/2018 | Muller | |
| 2012/0180200 | A1 * | 7/2012 | Gaudet | A42B 3/121 2/411 |
| 2013/0040524 | A1 | 2/2013 | Halldin et al. | |
| 2016/0073723 | A1 | 3/2016 | Halldin et al. | |

(Continued)

FOREIGN PATENT DOCUMENTS

| | | |
|---|---|---|
| WO | 2017/148958 | 9/2017 |
| WO | 2017/157765 | 9/2017 |

*Primary Examiner* — F Griffin Hall
(74) *Attorney, Agent, or Firm* — Michael Best & Friedrich LLP

(57) ABSTRACT

A helmet comprises an impact-absorbing shell and a pad assembly secured to an inner surface of the impact-absorbing shell. The pad assembly includes an outer low-friction layer, an inner low-friction layer, and a middle low-friction layer sandwiched between and slidable relative to the inner low friction layer and the outer low-friction layer. The middle low-friction layer is secured (e.g., with a hook-and-loop fastener) to the impact-absorbing shell such that the inner low-friction layer can slide relative to both the middle low-friction layer and the impact-absorbing shell. The outer low-friction layer can comprise an annulus-shaped sheet having a central opening, and the middle low-friction layer can comprises a disk-shaped sheet, such that the disk-shaped sheet is secured to the impact-absorbing shell through the central opening. The pad assembly can further comprise a resilient layer positioned adjacent an inner surface of the inner low-friction layer, and a flexible cover enclosing a substantial portion of the three low-friction layers.

22 Claims, 4 Drawing Sheets

(56) References Cited

U.S. PATENT DOCUMENTS

| | | | | |
|---|---|---|---|---|
| 2016/0113346 | A1* | 4/2016 | Lowe | A42B 3/105 2/412 |
| 2018/0027913 | A1 | 2/2018 | Thiel | |
| 2018/0213874 | A1* | 8/2018 | Lanner | A42B 3/127 |
| 2018/0303187 | A1* | 10/2018 | Hallander | A42B 3/064 |
| 2018/0303189 | A1* | 10/2018 | Hallander | A42C 2/00 |

* cited by examiner

HELMET PADS WITH SLIP LAYERS

BACKGROUND

The present invention relates to helmets and specifically to pads positioned in helmets between an outer shell and a user's head.

Modern helmets typically include an outer shell made from a hard plastic (e.g., polycarbonate), an impact-absorbing layer made of foam (e.g., EPS) secured to the inner surface of the outer shell, and an inner comfort layer on an inner surface of the impact-absorbing layer. The inner comfort layer commonly includes multiple individual pads made of soft, moisture-wicking material (e.g., open cell foam covered by a knit polyester, such as polypropylene) that provides a contact point of the helmet with the user's head. The soft foam provides a comfortable contact with the user's head and also can absorb sweat from the user. An example of an appropriate pad and materials is described in U.S. Pat. No. 9,872,532, which is hereby incorporated by reference in its entirety.

SUMMARY

The present invention provides a helmet comprising an impact-absorbing shell (e.g., comprising multiple layers, such as an outer polycarbonate shell and an energy-absorbing EPS layer) and a pad assembly secured to an inner surface of the impact-absorbing shell. The pad assembly includes an outer low-friction layer, an inner low-friction layer positioned closer to an interior of the helmet, and a middle low-friction layer sandwiched between and slidable relative to the inner low friction layer and the outer low-friction layer. The middle low-friction layer is secured to the impact-absorbing shell such that the inner low-friction layer can slide relative to both the middle low-friction layer and the impact-absorbing shell. Preferably, the middle low-friction layer is secured to the impact-absorbing shell by a detachable fastener, such as a hook-and-loop fastener.

In one embodiment, the outer low-friction layer comprises an opening, and the middle low-friction layer is secured to the impact-absorbing shell through the opening. For example, the outer low-friction layer can comprise an annulus-shaped sheet having a central opening, and the middle low-friction layer can comprises a disk-shaped sheet, such that the disk-shaped sheet is secured to the impact-absorbing shell through the central opening.

The pad assembly can further comprise a resilient layer positioned adjacent an inner surface of the inner low-friction layer. The pad assembly can further comprise a flexible cover enclosing a substantial portion of the three low-friction layers. For example, the flexible cover can include a hole, and the pad assembly can further comprise a detachable fastener connecting the middle low-friction layer to the impact-absorbing shell through the hole.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
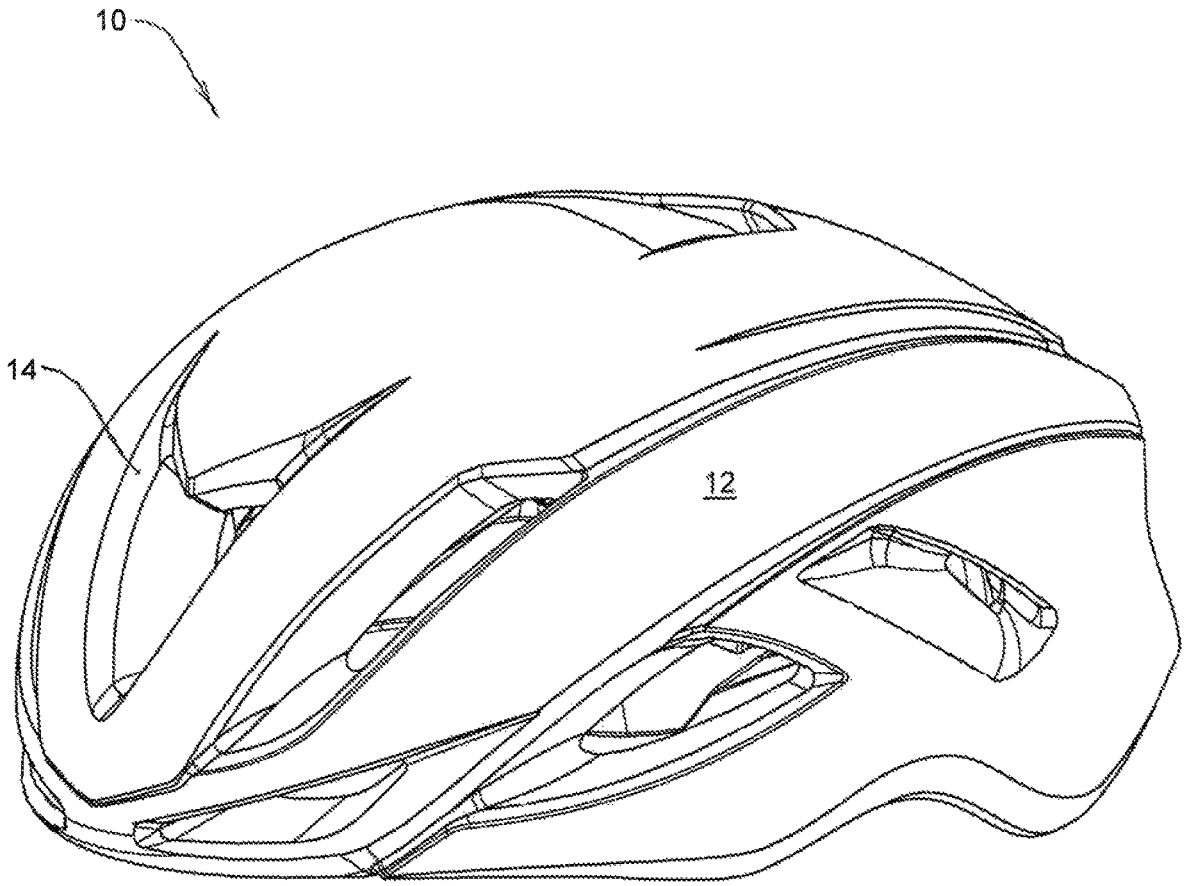
FIG. 1 is a perspective view of a helmet having pads embodying the present invention.

FIG. 1 illustrates a bicycle helmet 10 having an impact-absorbing shell comprising an outer shell 12 made of a hard plastic material, such as polycarbonate, and an energy-absorbing layer 14 secured to an inner surface of the outer shell 12. The energy-absorbing layer 14 can be any suitable material and in the illustrated embodiment is expanded polystyrene (EPS). It should be understood that the impact-absorbing shell can comprise single-layer or multi-layer configurations in a variety of different materials without departing from the present invention.

Figure 2:
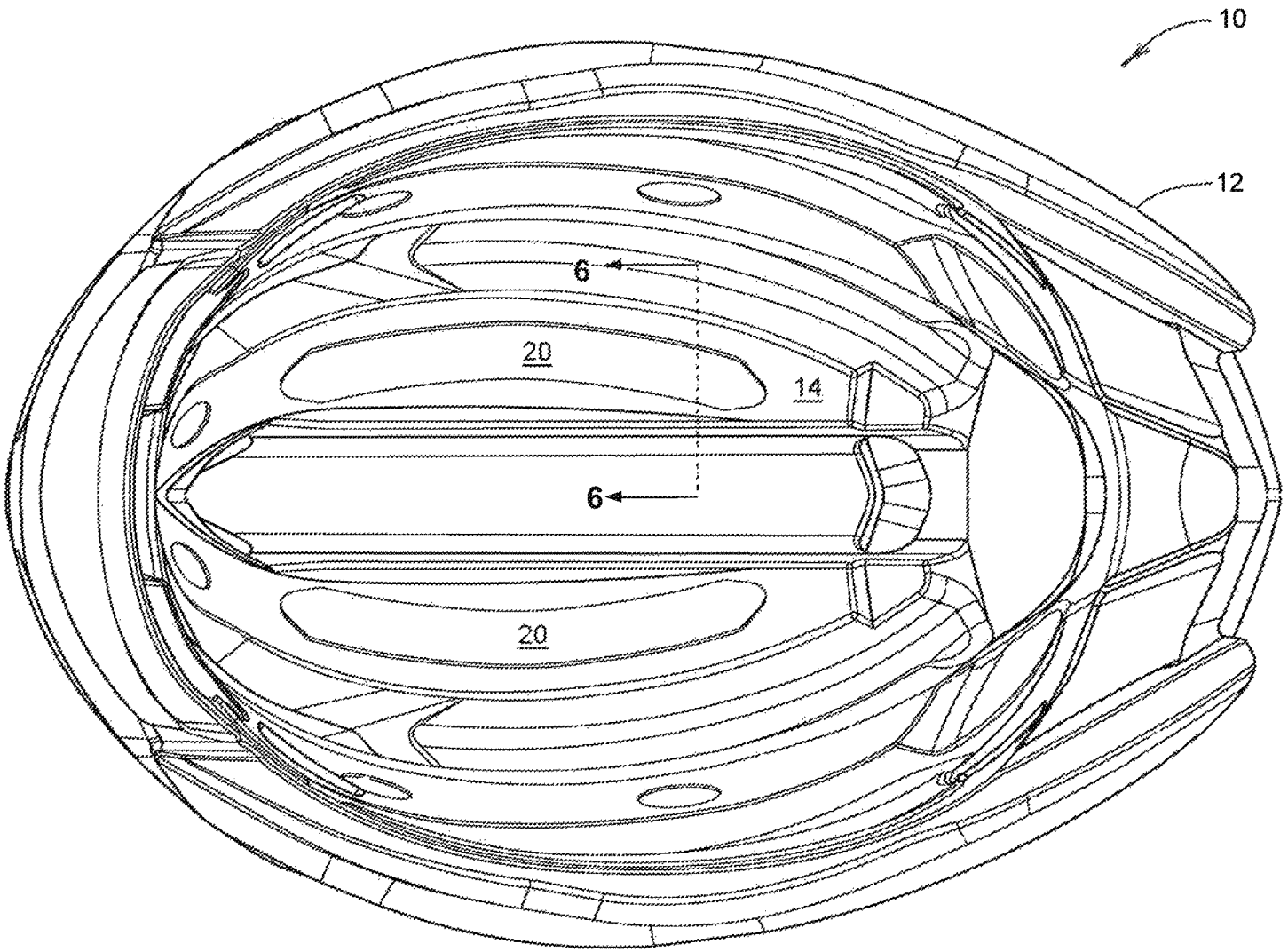
FIG. 2 is a bottom view of the helmet from FIG. 1, showing pad assemblies embodying the present invention.

Referring to FIG. 2, the impact-absorbing shell is provided with a plurality of pad assemblies 20 secured to an inner surface of the energy-absorbing layer 14 to provide an interface between the energy-absorbing layer 14 and the user's head 22. These pad assemblies 20 can be provided in a variety of configurations and numbers, and only two such pad assemblies 20 are shown in FIG. 2.

Figure 3:
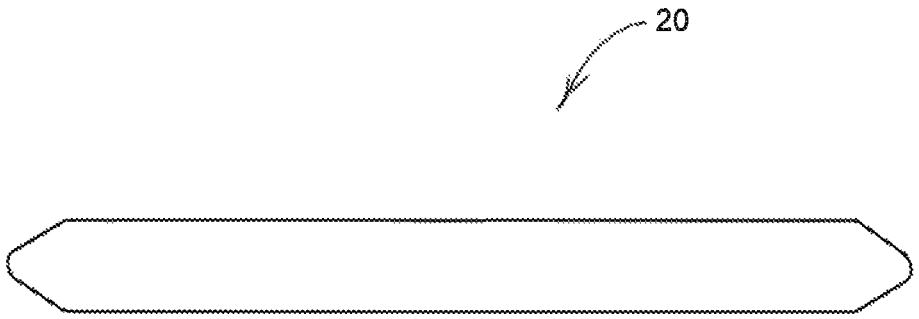
FIG. 3 is a top view of one of the pad assemblies in FIG. 2.
Figure 4:
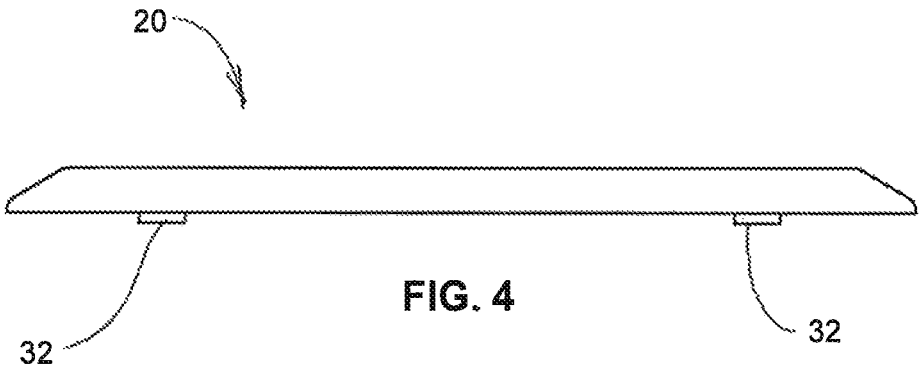
FIG. 4 is a side view of the pad assembly in FIG. 3.
Figure 5:
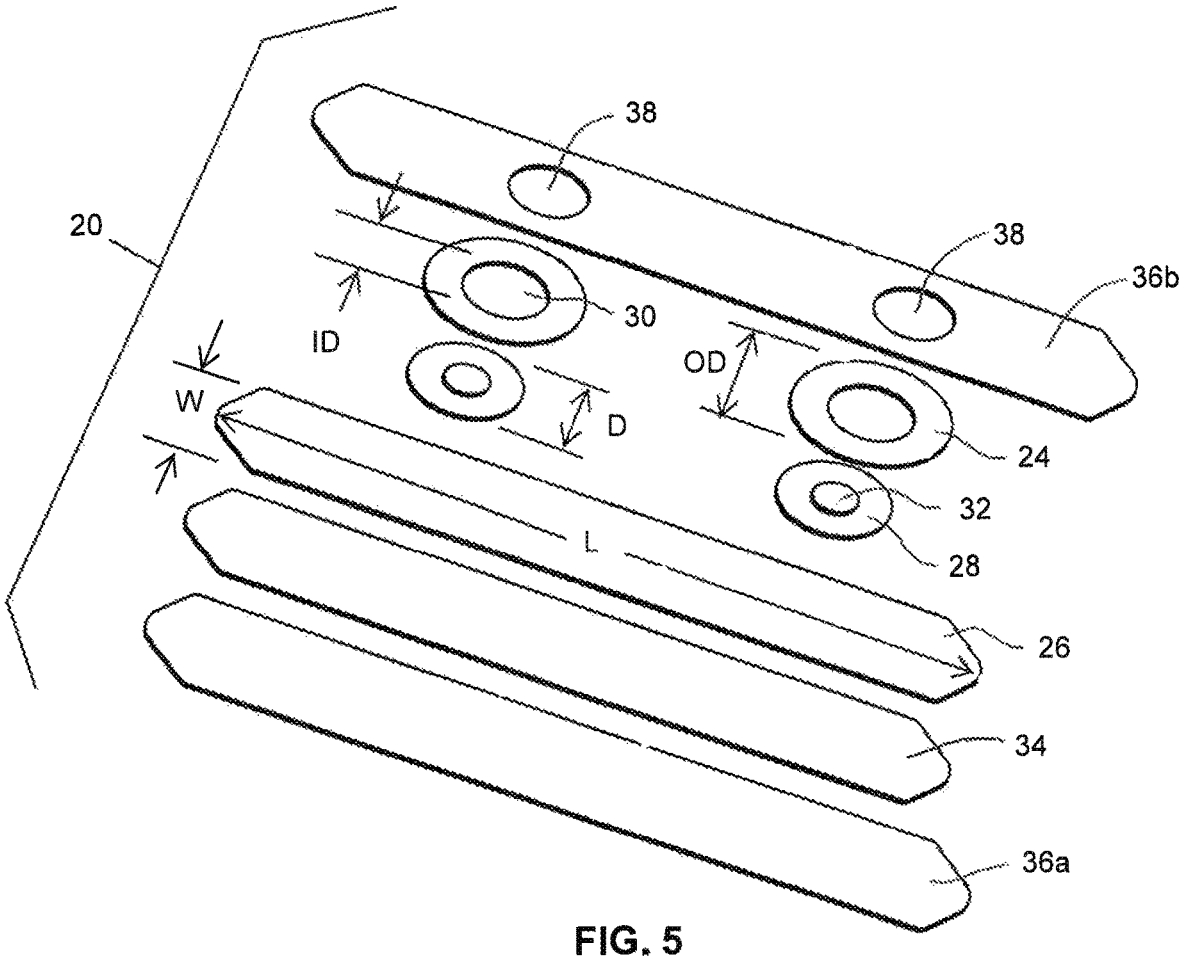
FIG. 5 is an exploded view of the pad assembly in FIG. 3.
Figure 6:
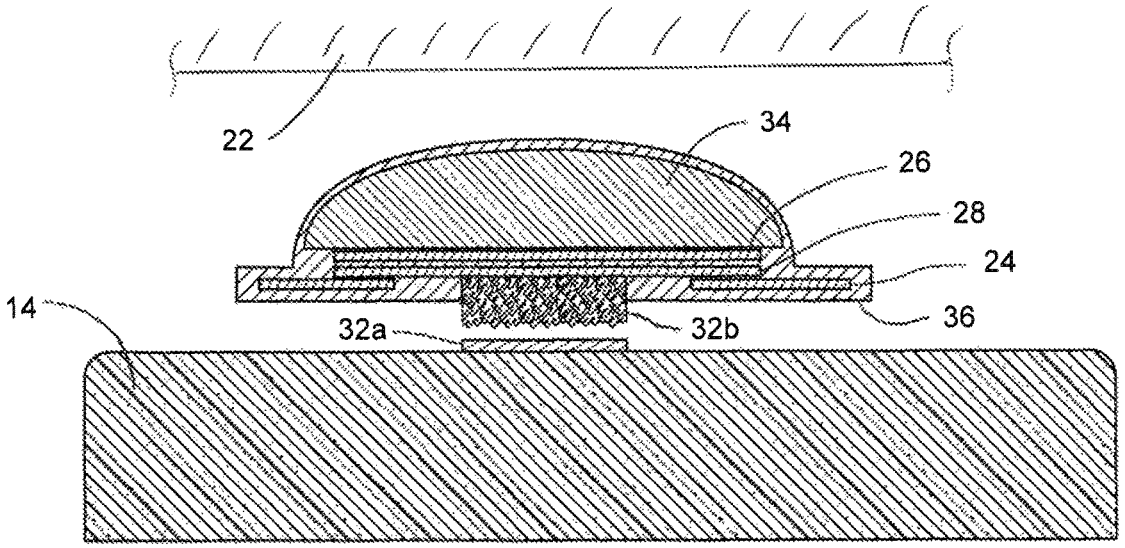
FIG. 6 is a section view taken along line 6-6 in FIG. 2.

Referring to FIGS. 3-5, each illustrated pad assembly 20 has an elongated configuration that is design to fit in the helmet illustrated in FIGS. 1-2. However, it should be understood that the pad assemblies 20 can be provided is a variety of shapes and sizes.

The illustrated pad assembly 20 comprises a multi-layered arrangement that facilitates some lateral movement between the layers. More specifically, the pad assembly 20 includes an outer low-friction layer 24, an inner low-friction layer 26 positioned closer to an interior of the helmet, and a middle low-friction layer 28 sandwiched between and slidable relative to the inner low-friction layer 26 and the outer low-friction layer 24. Each of the low-frictions layers comprises a low-friction material, such as polycarbonate, polytetrafluoroethylene, or other suitable low-friction material. The illustrated arrangement includes a single, elongated inner low-friction layer 26 and two each of the middle low-friction layer 28 and outer low-friction layer 24. It should be understood that other arrangements are possible.

The illustrated inner low-friction layer 26 has an elongated shape having a length L and a width W, similar to some prior helmet pads. The middle low-friction layer 28 is disk-shaped and has a diameter D that is about the same as the width W of the inner low-friction layer 26. The outer low-friction layer 24 is annulus-shaped and has an outer diameter OD that is larger than the width W and a central opening 30 with an inner diameter ID that is smaller than the width W.

The middle low-friction layer 28 is secured to the energy-absorbing layer 14 such that the inner low-friction layer 26 can slide relative to both the middle low-friction layer 28 and the energy-absorbing layer 14. In particular, the pad assembly 20 further includes a detachable fastener 32 in the form of a hook-and-loop fastener secured between the middle low-friction layer 28 and the energy-absorbing layer 14. For example, the hook portion 32*a* can be adhered to the energy-absorbing layer 14 and the loop portion 32*b* can be adhered to the middle low-friction layer 28.

The illustrated pad assembly 20 further includes a resilient layer 34 positioned adjacent an inner surface of the inner low-friction layer 26. The resilient layer 34 preferably comprises a soft open-cell foam, such as polyurethane, which provides a comfortable interface between the energy-absorbing layer 14 and the user's head 22.

The illustrated pad assembly 20 further includes a flexible cover 36 enclosing a substantial portion of the three low-friction layers. More specifically, the illustrated flexible cover comprises an inner portion 36*a* and an outer portion 36*b* that are secured (e.g., stitched) together around their respective peripheries to defined an inner volume that retains the three low-friction layers. The outer portion 36*b* of the cover includes holes 38 aligned with the central openings 30 in the outer low-friction layers 24 so that the detachable fastener 32 can secure the middle low-friction layer 28 to the energy-absorbing layer 14.

By virtue of the above-described arrangement, the pad assembly 20 is a single-unit assembly that can be installed and removed from the helmet for any reason, such as to wash or replace the pad assembly 20. This pad assembly 20 could also be designed to replace standard pad assemblies in existing helmets. The pad assembly 20 facilitates movement between the impact-absorbing shell (e.g., the energy-absorbing layer 14) and the user's head by allowing low-friction movement of the middle low-friction layer 28 (which is secured to the impact-absorbing shell) and the inner low-friction layer 26, resilient layer 34 and inner portion 36 of the cover (which can move with the user's head). This arrangement dampens the rotational impact that will be imparted to the user's head in the event of a rotational impact on the helmet.

Various features and advantages of the invention are set forth in the following claims.

The invention claimed is:

1. A helmet comprising:

an impact-absorbing shell having an outer shell and an energy-absorbing layer secured to an inner surface of the outer shell; and a pad assembly secured to the energy-absorbing layer such that the entire pad assembly is disposed on one side of the energy-absorbing layer, the pad assembly including:

an outer low-friction layer;

an inner low-friction layer, the inner low-friction layer being positioned closer to an interior of the helmet than is the outer low-friction layer, wherein the outer low-friction layer is spaced from both the inner low-friction layer and the energy-absorbing layer; and a middle low-friction layer sandwiched between and slidable relative to the inner low friction layer and the outer low-friction layer, wherein the middle low-friction layer is secured to the impact-absorbing shell by a fastener such that the fastener limits motion of the middle low-friction layer relative to the inner surface of the impact-absorbing shell, and such that the inner low-friction layer is able to slide relative to both the middle low-friction layer and the impact-absorbing shell, wherein the fastener is secured directly to the middle low-friction layer.

2. A helmet as claimed is claim 1, wherein the fastener comprises a detachable fastener.

3. A helmet as claimed is claim 2, wherein the detachable fastener comprises a hook-and-loop fastener.

4. A helmet as claimed is claim 1, wherein the outer low-friction layer comprises a through opening, and wherein the fastener secures the middle low-friction layer to the impact-absorbing shell through the through opening.

5. A helmet as claimed is claim 1, wherein the outer low-friction layer comprises an annulus-shaped sheet having a central opening, wherein the middle low-friction layer comprises a disk-shaped sheet, and wherein the fastener secures the disk-shaped sheet to the impact-absorbing shell through the central opening.

6. A helmet as claimed is claim 1, wherein the pad assembly further comprises a resilient layer positioned adjacent an inner surface of the inner low-friction layer.

7. A helmet as claimed is claim 1, wherein the pad assembly further comprises a flexible cover enclosing a substantial portion of the outer low-friction layer, the inner low-friction layer, and the middle low-friction layer.

8. A helmet as claimed is claim 7, wherein the flexible cover includes a hole and wherein the fastener secures the middle low-friction layer to the impact-absorbing shell through the hole.

9. A helmet as claimed in claim 7, wherein the flexible cover includes an inner portion and an outer portion that are secured together to define an inner volume that contains the inner low-friction layer, the outer low-friction layer, and the middle low-friction layer.

10. A helmet as claimed in claim 1, wherein the fastener includes one of a hook portion or loop portion fixed to an inner surface of the energy-absorbing layer, and the other of the hook portion or loop portion is fixed to the middle low-friction layer.

11. A pad assembly configured to be secured to an energy-absorbing layer of an impact-absorbing shell of a helmet, the impact-absorbing shell having an outer shell and the energy-absorbing layer secured to an inner surface of the outer shell, such that the entire pad assembly is disposed on one side of the energy-absorbing layer, the pad assembly including:

an outer low-friction layer;

an inner low-friction layer, the inner low-friction layer configured to be positioned closer to an interior of the helmet than is the outer low-friction layer, wherein the outer low-friction layer is spaced from both the inner low-friction layer and the energy-absorbing layer;

a middle low-friction layer sandwiched between and slidable relative to the inner low friction layer and the outer low-friction layer; and a fastener secured directly to the middle low-friction layer and configured to facilitate securing the middle low-friction layer to the inner surface of the impact-absorbing shell such that the fastener limits motion of the middle low-friction layer relative to the inner surface of the impact-absorbing shell, and such that the inner low-friction layer is able to slide relative to both the middle low-friction layer and the impact-absorbing shell.

12. A pad assembly as claimed is claim 11, wherein the fastener comprises a detachable fastener.

13. A pad assembly as claimed is claim 12, wherein the detachable fastener comprises a hook-and-loop fastener.

14. A pad assembly as claimed is claim 11, wherein the outer low-friction layer comprises a through opening, and wherein the fastener is configured to facilitate securing the middle low-friction layer to the impact-absorbing shell through the through opening.

15. A pad assembly as claimed is claim 11, wherein the outer low-friction layer comprises an annulus-shaped sheet having a central opening, wherein the middle low-friction layer comprises a disk-shaped sheet, and wherein the fastener is configured to facilitate securing the disk-shaped sheet to the impact-absorbing shell through the central opening.

16. A pad assembly as claimed is claim 11, wherein the pad assembly further comprises a resilient layer positioned adjacent an inner surface of the inner low-friction layer.

17. A pad assembly as claimed is claim 11, wherein the pad assembly further comprises a flexible cover enclosing a substantial portion of the outer low-friction layer, the inner low-friction layer, and the middle low-friction layer.

18. A pad assembly as claimed is claim 17, wherein the flexible cover includes a hole and wherein the fastener is configured to facilitate securing the middle low-friction layer to the impact-absorbing shell through the hole.

19. A pad assembly as claimed in claim 17, wherein the flexible cover includes an inner portion and an outer portion that are secured together to define an inner volume that contains the inner low-friction layer, the outer low-friction layer, and the middle low-friction layer.

20. A helmet as claimed is claim 1, wherein the fastener is positioned between the middle low-friction layer and the impact-absorbing shell.

21. A helmet as claimed is claim 1, wherein the fastener is directly secured to the inner surface of the impact-absorbing shell.

22. A pad assembly as claimed in claim 11, wherein the fastener includes one of a hook portion or loop portion configured to be fixed to an inner surface of the energy-absorbing layer, and the other of the hook portion or loop portion is fixed to the middle low-friction layer.

* * * * *